US006570307B2

(12) United States Patent
Ullrich et al.

(10) Patent No.: US 6,570,307 B2
(45) Date of Patent: May 27, 2003

(54) OPTICAL RADIATOR WITH ANTI-EXTRACTION LOCK

(75) Inventors: Bernd Ullrich, Erlensee (DE); Klaus Spitzenberg, Mainhausen (DE)

(73) Assignee: Heraeus Noblelight GmbH, Hanau (DE)

( * ) Notice: Subject to any disclaimer, the term of this patent is extended or adjusted under 35 U.S.C. 154(b) by 127 days.

(21) Appl. No.: 09/810,726

(22) Filed: Mar. 16, 2001

(65) Prior Publication Data

US 2001/0026118 A1 Oct. 4, 2001

(30) Foreign Application Priority Data

Mar. 30, 2000 (DE) ..... 100 15 558

(51) Int. Cl.[7] ..... H01J 5/48; H01J 5/50

(52) U.S. Cl. ..... 313/318.01; 313/318.09; 313/318.07

(58) Field of Search ..... 313/318.01, 318.07, 313/318.09

(56) References Cited

U.S. PATENT DOCUMENTS

| | | | | |
|---|---|---|---|---|
| 2,240,333 A | | 4/1941 | Hodge | |
| 3,882,346 A | | 5/1975 | McVey | |
| 4,254,355 A | | 3/1981 | Taylor | |
| 5,032,758 A | * | 7/1991 | Davenport et al. | 313/113 |
| 5,270,610 A | * | 12/1993 | Schoenherr et al. | 313/113 |
| 5,291,092 A | * | 3/1994 | Coushaine | 313/113 |
| 5,386,173 A | * | 1/1995 | Kosmatka | 313/318.01 |
| 5,463,270 A | * | 10/1995 | Wakimizu et al. | 313/318.01 |
| 5,903,093 A | * | 5/1999 | Seiler et al. | 313/25 |
| 6,031,323 A | * | 2/2000 | Behr et al. | 313/318.01 |
| 6,107,738 A | | 8/2000 | Ullrich et al. | |
| 6,232,707 B1 | * | 5/2001 | Ranish et al. | 313/318.01 |
| 6,294,861 B1 | * | 9/2001 | Mochiduki et al. | 313/318.01 |

FOREIGN PATENT DOCUMENTS

| | | |
|---|---|---|
| DE | 197 52 120 A1 | 8/1998 |
| EP | 0 157 357 | 10/1985 |
| EP | 0 321 867 | 6/1989 |
| EP | 0 856 870 | 8/1998 |
| FR | 2 665 022 | 1/1922 |
| FR | 2 435 815 | 4/1980 |
| JP | 05 135 688 | 6/1993 |

* cited by examiner

*Primary Examiner*—Ashok Patel
*Assistant Examiner*—Glenn Zimmerman
(74) *Attorney, Agent, or Firm*—Fulbright & Jaworski L.L.P.

(57) ABSTRACT

The invention relates to an optical radiator, especially for ultraviolet or infrared radiation, with a lamp bulb socketed without cement on one end, from which at least two connecting wires are brought through pinches, one at the top and the other at the bottom of the lamp bulb, the first connecting wire being affixed at the upper end of the lamp bulb to a stiff support bow, and the lower end of the stiff support bow being brought as a terminal pin through a first bore in a lamp base and is fastened to the latter by an anti-extraction lock. The invention is addressed to the problem of offering an optical radiator which can be made quickly and at low cost from a minimal number of parts. The problem is solved in that the second connecting wire at the bottom end of the lamp bulb is carried loosely through a second bore in the lamp base.

10 Claims, 4 Drawing Sheets

OPTICAL RADIATOR WITH ANTI-EXTRACTION LOCK

BACKGROUND AND SUMMARY OF THE INVENTION

The invention relates to an optical radiator, especially for ultraviolet or infrared radiation, with a lamp bulb based cement-free at one end, out of which at least two connecting wires are brought, each through a pinch, one at the upper end and the other at the lower end of the lamp bulb, the first connecting wire being affixed at the upper end of the lamp bulb to the upper end of a stiff support bow, and the lower end of the stiff support bow being brought as a terminal pin through a first bore in a lamp base and is fastened to the latter with an anti-extraction lock.

The invention refers to an optical radiator, such as is used, for example, as a heat radiator or as an UV radiator for tanning, sterilization, surface treatment, or for drying and curing thin coatings. Due to the high power of UV or IR radiators, relatively high temperatures are produced, so that thermal expansion and heat stress which they entail are important in the structural configuration and choice of materials of the radiators.

Such radiators are disclosed in German Patent Application 197 52 120 A1, which discloses an optical radiator based cement-free at one end in a ceramic lamp base, through which two terminal pins are brought for connecting the connecting wires protruding at top and bottom from the lamp bulb. The terminal pin for connecting the upper connecting wire is made in one piece as a stiff support bow. The terminal pin for connecting the lower connecting wire either is bent or it comes out straight. If this terminal pin is straight, the lower connecting wire is bent. The connection between terminal pins or the stiff support bow and the connecting wires respectively is performed preferentially by spot welding. The two terminal pins are provided with an anti-extraction lock each at the upper and the lower ends of the bores in the lamp base. The term, anti-extraction lock is to be understood to mean an appropriate configuration of the terminal pin or a component clutching the terminal pin, whereby the complete extraction of the terminal pin through the bore in the lamp base is prevented. This does not prevent free play of the terminal pin within the bore.

The invention is addressed to the problem of offering an optical radiator which can be made quickly and inexpensively from a minimum of parts.

The problem is solved in that the second connecting wire at the lower end of the lamp bulb is brought loosely through a second bore in the lamp base. Thus, on the one hand there is no need for an additional terminal pin for connecting this second connecting wire to the lower end of the lamp bulb, nor on the other hand for anti-extraction locks on this terminal pin. The second connecting wire at the lower end of the lamp bulb is accordingly not connected to the lamp base, and the second bore serves only to guide the second connecting wire. By the floating suspension of the lamp bulb at one end, thermal expansion due to the high power and temperatures of the UV or IR radiators are easily possible. The mounting of the radiator is substantially simplified, which in addition to the saving of parts has a cost reducing effect.

It is especially advantageous if the second connecting wire and the lower end of the stiff support bow, used as terminal pin, are connected each on the side of the lamp base remote from the lamp base with a flexible conductor. The connection can be made by welding, for example. To prevent short circuits, the conductors should be surrounded, for example, by an insulating fabric layer. Ideally, the lamp base has a mounting device. The term, mounting device, is to be understood as any conceivable structural configuration of the lamp base that is suitable for fastening the optical radiator to a later place of use. Screw threading, plugs or clamp connections can be used. The mounting device therefore serves merely for mechanical fixation, not for the electrical connection of the radiator. The electrical connection of the radiator is performed through flexible conductors so that relief of the electrical wiring from tensional stresses is achieved by the mounting device.

One possible embodiment of the mounting device is formed by two openings or notches on the side of the lamp base remote from the lamp bulb. Screws, for example, can be passed through the two openings in order to affix the radiator to the place of use. The two openings can, however, also be used for a plug-in connection.

It is especially advantageous if the stiff support bow has a bulge in the area of the lamp base which acts simultaneously as an anti-extraction and rotation lock. Appropriate for the purpose are U-shaped bends of the stiff support bow or bulges which are formed by a change in the cross section of the stiff support bow.

The length of the optical radiator can advantageously be shortened if the lamp base on the side facing the lamp bulb has a recess in the area of the second bore, and if the pinch on the lower end of the lamp bulb through which the second connecting wire is brought out, enters at least possible into the recess. This embodiment is to be recommended especially if there is little space available for the installation of the radiator at the place of use.

It is advantageous also if the first bore on the side of the lamp base facing the lamp bulb is adapted in shape to serve to prevent rotation of the bulge in the stiff support bow.

FIGS. 1 to 6*d* show by way of example a possible embodiment of an optical radiator according to the invention, wherein concealed lines are drawn thinner than visible lines.

DETAILED DESCRIPTION

Figure 1:
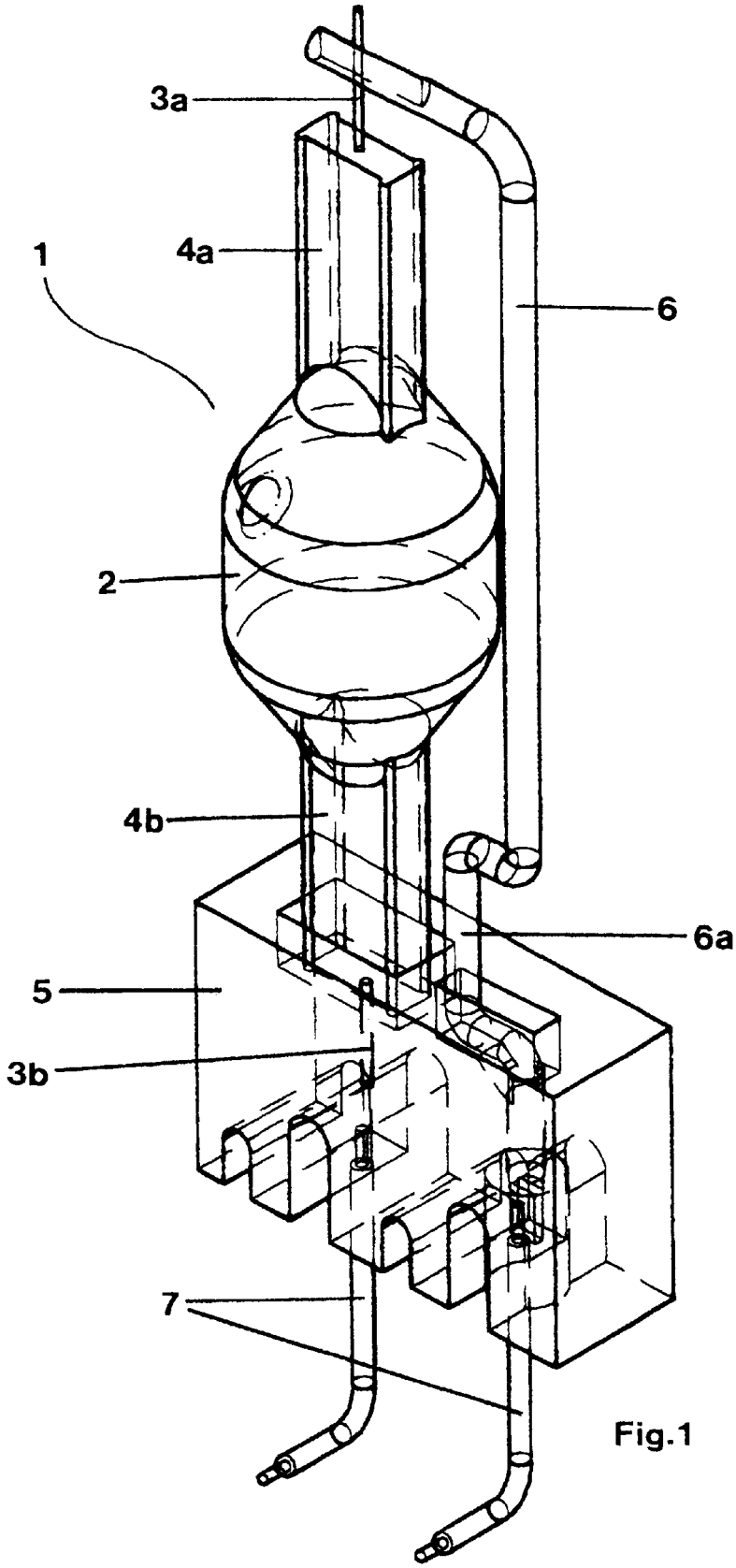
FIG. 1A three-dimensional representation of an optical radiator ready for use FIG. 2 A three-dimensional representation of a lamp base FIG. 3 A top view of the lamp base of FIG. 2

FIG. 1 shows an optical radiator 1 with a lamp bulb 2 out of which two connecting wires 3*a* and 3*b* each run through a pinch 4*a* and 4*b* at the upper and lower end of the lamp bulb 2. Furthermore, a lamp base 5 and a stiff support bow 6 with a U-shaped bulge 6*a* are shown. The upper end of the stiff support bow 6 is joined to the first connecting wire 3*a* by a spot weld. The lower end of the stiff support bow 6 and of the connecting wire 3*b* are brought through the lamp base 5 and each conductively connected on the side of the lamp base 5 remote from the lamp bulb 2 by a welded connection with a flexible connecting line 7. At the side of the lamp base 5 remote from the lamp bulb 2 there is an anti-extraction lock, here not represented, which fastens the stiff support bow 6 to the lamp base 5 on the spot. The stiff support bow 6 thus determines the position of the lamp bulb 2 in space.

Figure 2:
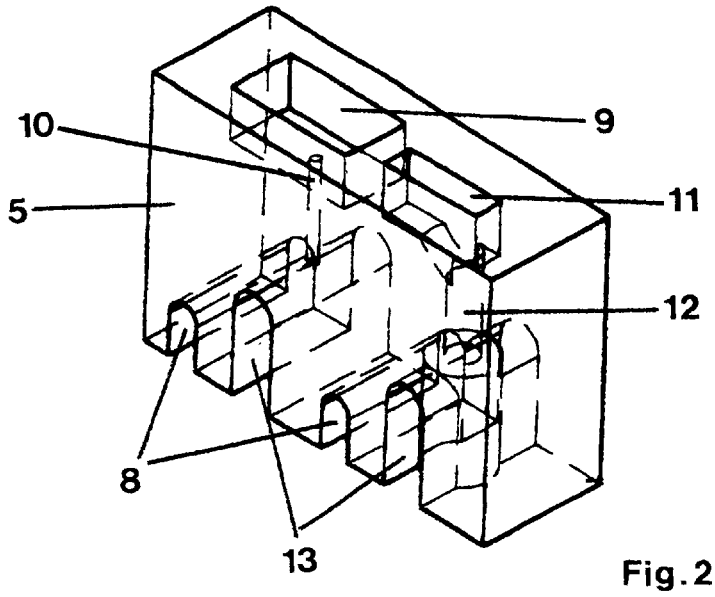

FIG. 2 shows the lamp base 5 from FIG. 1 with a mounting device which is formed by two openings 8 on the side of the lamp base 5 remote from the lamp bulb 2. A recess 9 with a centrally disposed second bore 10 is to be seen in the lamp base 5, the second bore 10 being suitable for receiving the second connecting wire 3*b*, and recess 9 for receiving the pinch 4*b* on the lower end of the lamp bulb 2. Alongside the recess 9 there is the end 11 of the first bore 12 facing the lamp bulb 2, the end 11 of bore 12 being adapted to conform to the bulge 6*a* of the stiff support bow 6. Each of the two bores 10 and 12 are traversed on the side of the lamp base 5 remote from the lamp bulb 2 by notches 13 which permit or at least facilitate providing an anti-extraction lock on the stiff support bow 6 and the connection of the flexible connecting wires 7 to the stiff support bow 6 and the second connecting wire 3*b*.

Figure 3:
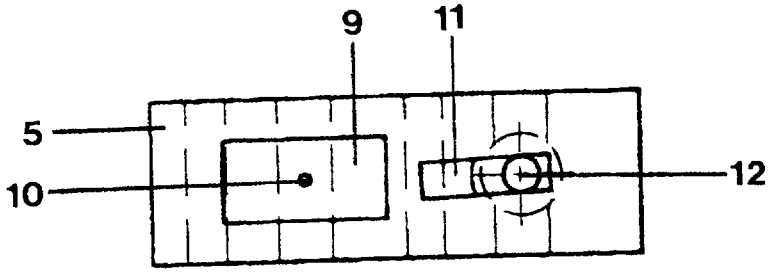

FIG. 3 shows the lamp base 5 of FIG. 2 in a top view, wherein the second bore 10 with the recess 9 as well as the first bore 12 with its end 11.

Figure 4:
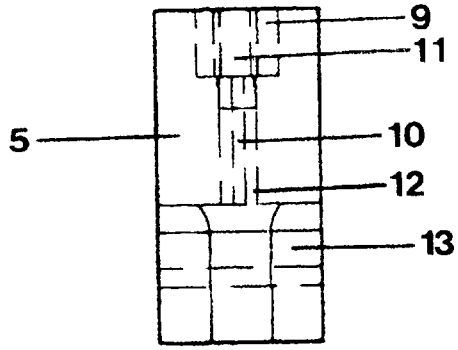
FIG. 4 A side view of the lamp base of FIG. 2.

FIG. 4 shows the lamp base 5 of FIG. 2 in a side view, wherein the first bore 12 with its end 11, the second bore 10, the notches 13 and recess 9 are arranged concealed in the lamp base 5.

Figure 5:
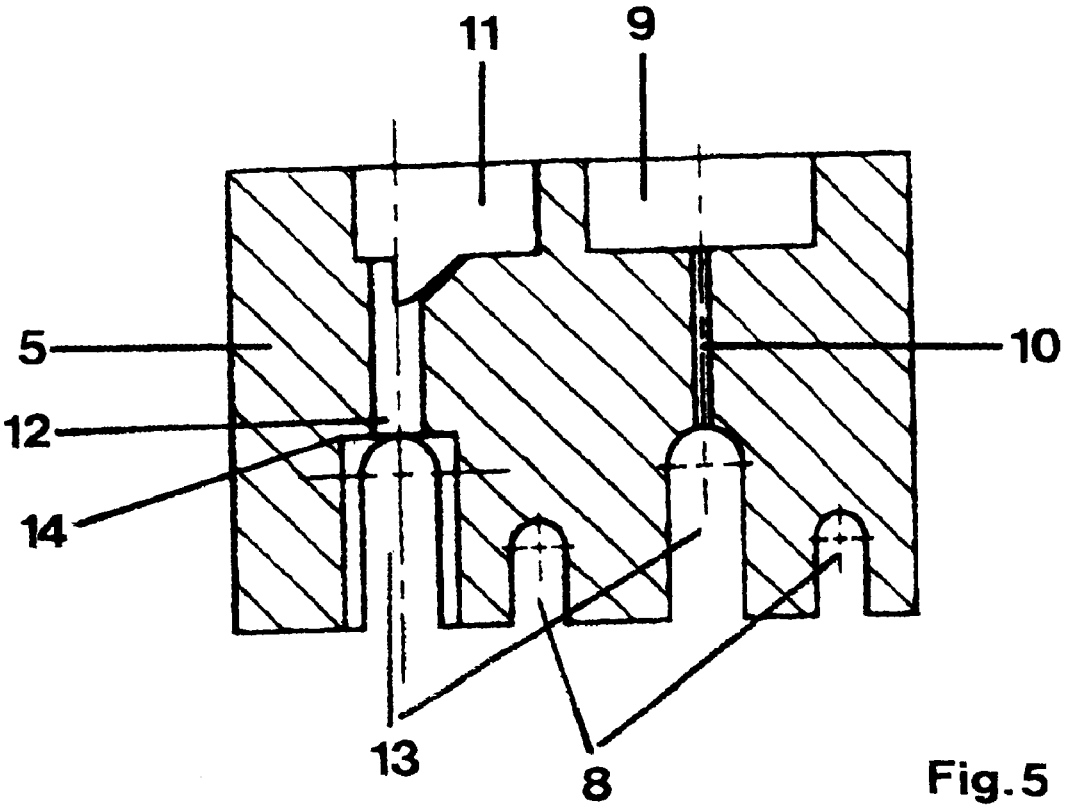
FIG. 5 A sectional view of the lamp base of FIG. 2

FIG. 5 shows the lamp base of FIG. 2 in a sectional view, wherein the openings 8 provided for the mechanical fastening of the lamp base 5, the notches 13, as well as a ledge 14 under bore 12 can be seen which here serves for the attachment of an anti-extraction lock not shown. The diameter of the first bore 12 is matched to the stiff support bow 6, while the diameter of the second bore 10 is matched to the second connecting wire 3*b*. The upper end 11 of the first bore 12 is provided with a ramp in the area of the U-shaped bulge 6*a* of the support bow 6 associated with the lamp bulb 2 in order to surround at least partially as snugly as possible the bulge 6*a* of the stiff support bow 6.

Figure 6A:
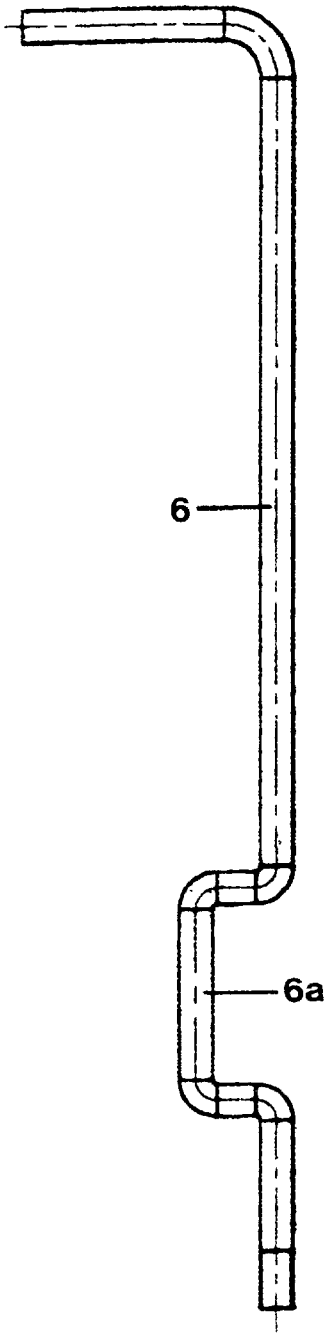
FIGS. 6*a* to 6*d*: Stiff support bow with a U-shaped bulge, seen from different viewing angles.
Figure 6B:
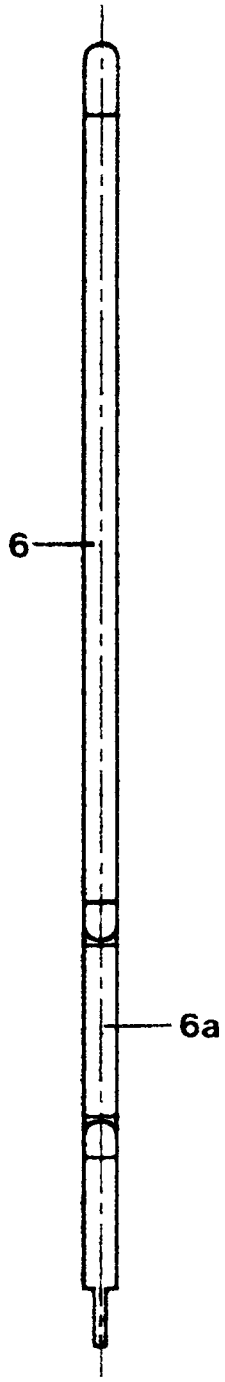
Figure 6C:
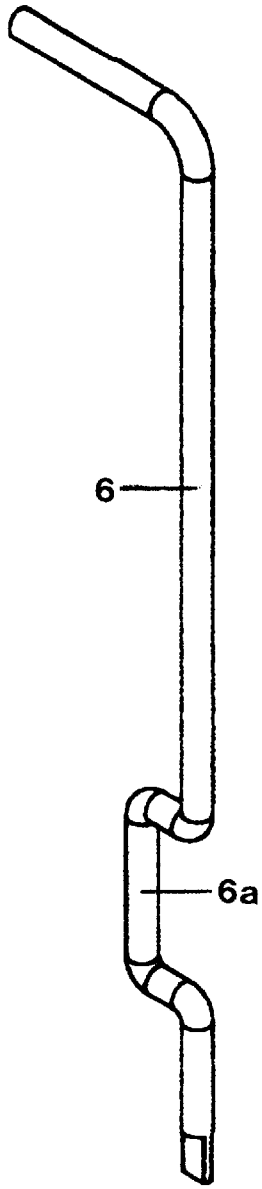

FIGS. 6*a* to 6*c* show a stiff, wire-like support bow 6 with a U-shaped bulge 6*a*, from different viewing angles.

Figure 6D:
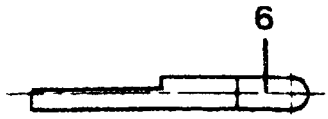

FIG. 6*d* shows the upper end of the support bow 6 in the area of connection to the first connecting wire 3*a*, wherein the upper end has a point flattened on one side to facilitate the spot welding process.

What is claimed is:

1. An optical radiator comprising a lamp bulb socketed without cement at one end, out of which at least two connecting wires are brought, each through a pinch, one at the upper end and the other at the lower end of the lamp bulb, the first connecting wire being affixed at the upper end of the lamp bulb to the upper end of a stiff support bow, and the lower end of the support bow being brought as a terminal pin through a first bore in a lamp base and is fastened to the latter by an anti-extraction lock, wherein said second connecting wire at the lower end of the lamp bulb is carried loosely through a second bore in the lamp base and wherein the support bow has a bulge in the area of the lamp base, wherein the side of the first bore on the lower of the lamp base facing the lamp bulb is adapted in shape at least partially to prevent the rotation of the bulge of the stiff support bow.

2. The optical radiator according to claim 1, wherein the second connecting wire and lower end of the support bow, used as a terminal pin, are connected each with a flexible connecting conductor on the side of the lamp base remote from the lamp bulb.

3. The optical radiator according to claim 1, wherein the lamp base has a mounting device.

4. The optical radiator according to claim 3, wherein the mounting device is formed by two openings on the end of the lamp base remote from the lamp bulb.

5. The optical radiator of claim 1, wherein the bulge is U-shaped.

6. The optical radiator according to claim 1, wherein the bulge is formed by a change in the cross section of the stiff support bow.

7. The optical radiator according to claim 1, wherein the lamp base has a recess on the side facing the lamp bulb in the area of the second bore and the pinch at the lower end of the lamp bulb, through which the second connecting wire is brought out, enters at least partially into the recess.

8. An optical radiator comprising a lamp bulb socketed without cement at one end, out of which at least two connecting wires are brought, each through a pinch, one at the upper end and the other at the lower end of the lamp bulb, the first connecting wire being affixed at the upper end of the lamp bulb to the upper end of a stiff support bow, and the lower end of the support bow being brought as a terminal pin through a first bore in a lamp base and is fastened to the latter by an anti-extraction lock, wherein said second connecting wire at the lower end of the lamp bulb is carried loosely through a second bore in the lamp base wherein the support bow has a U-shaped bulge in the area of the lamp base.

9. An optical radiator comprising a lamp bulb socketed without cement at one end, out of which at least two connecting wires are brought, each through a pinch, one at the upper end and the other at the lower end of the lamp bulb, the first connecting wire being affixed at the upper end of the lamp bulb to the upper end of a stiff support bow, and the lower end of the support bow being brought as a terminal pin through a first bore in a lamp base and is fastened to the latter by an anti-extraction lock, wherein said second connecting wire at the lower end of the lamp bulb is carried loosely through a second bore in the lamp base wherein the support bow has a bulge in the area of the lamp base that is formed by a change in the cross section of the stiff support bow.

10. An optical radiator comprising a lamp bulb socketed without cement at one end, out of which at least two connecting wires are brought, each through a pinch, one at the upper end and the other at the lower end of the lamp bulb, the first connecting wire being affixed at the upper end of the lamp bulb to the upper end of a stiff support bow, and the lower end of the support bow being brought as a terminal pin through a first bore in a lamp base and is fastened to the latter by an anti-extraction lock, wherein said second connecting wire at the lower end of the lamp bulb is carried loosely through a second bore in the lamp base wherein the side of the first bore on the lower of the lamp base facing the lamp bulb is adapted in shape at least partially to prevent rotation of the bulge of the stiff support bow.

* * * * *